United States Patent [19]

Hill

[11] Patent Number: 4,936,581

[45] Date of Patent: Jun. 26, 1990

[54] NUMBER SELECTOR AND MARKER FOR LOTTERY CARD

[76] Inventor: Roger D. Hill, 5475 Hansom Rd., St. Cloud, Fla. 32769

[21] Appl. No.: 354,463

[22] Filed: May 19, 1989

Related U.S. Application Data

[63] Continuation-in-part of Ser. No. 242,829, Sep. 12, 1988, abandoned.

[51] Int. Cl.[5] ..... A63F 9/00

[52] U.S. Cl. ..... 273/138 R; 273/144 B; 273/148 R

[58] Field of Search ..... 273/138 R, 144 R, 144 B, 273/148 R

[56] References Cited

U.S. PATENT DOCUMENTS 4,444,394 4/1984 Pasquine ..... 273/144 B

FOREIGN PATENT DOCUMENTS 1094170 12/1960 Fed. Rep. of Germany ... 273/144 B
3346545 6/1985 Fed. Rep. of Germany ... 273/148 B
2560057 8/1985 France ..... 273/148 B
2571626 4/1986 France ..... 273/148 B

*Primary Examiner*—Anton O. Oechsle
*Attorney, Agent, or Firm*—Julian C. Renfro

[57] ABSTRACT

A number selector and card marker in accordance with this invention is usable in connection with the marking of a card or play slip, and it comprises a substantially flat housing having a slot therein for receiving at least a portion of the card. One part of the housing has a series of closely spaced, carefully aligned holes of equal size, disposed in columns and rows. The placement of the holes of the series closely coincides with the placement of rectangular boxes to be found in the game grids of the card to be marked. An enclosure serves to enclose the series of holes as well as a plurality of small, equal size spheres. Each of these spheres is slightly larger than the holes, so as not to be able to pass therethrough, the size relationship of the spheres to the holes being such that a small portion of each sphere extends below its respective hole when the spheres have settled into the holes. A marking member is located in the housing directly below the series of holes and adjacent the aforementioned slot. A marking device is slidably disposed in the enclosure, for applying pressure to the spheres when they have randomly come to rest in respective holes, the pressure applied to such spheres manifesting itself through the marking member so as to bring about the marking of the boxes of a card reposing in the slot, to make the card readily readable.

39 Claims, 5 Drawing Sheets

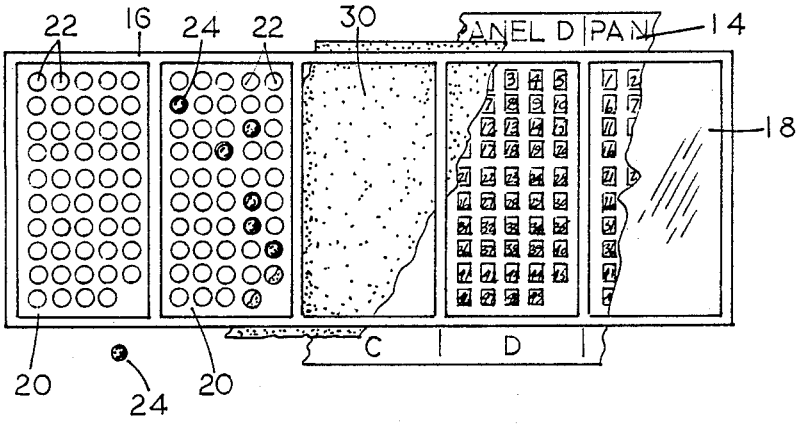
FIG 2
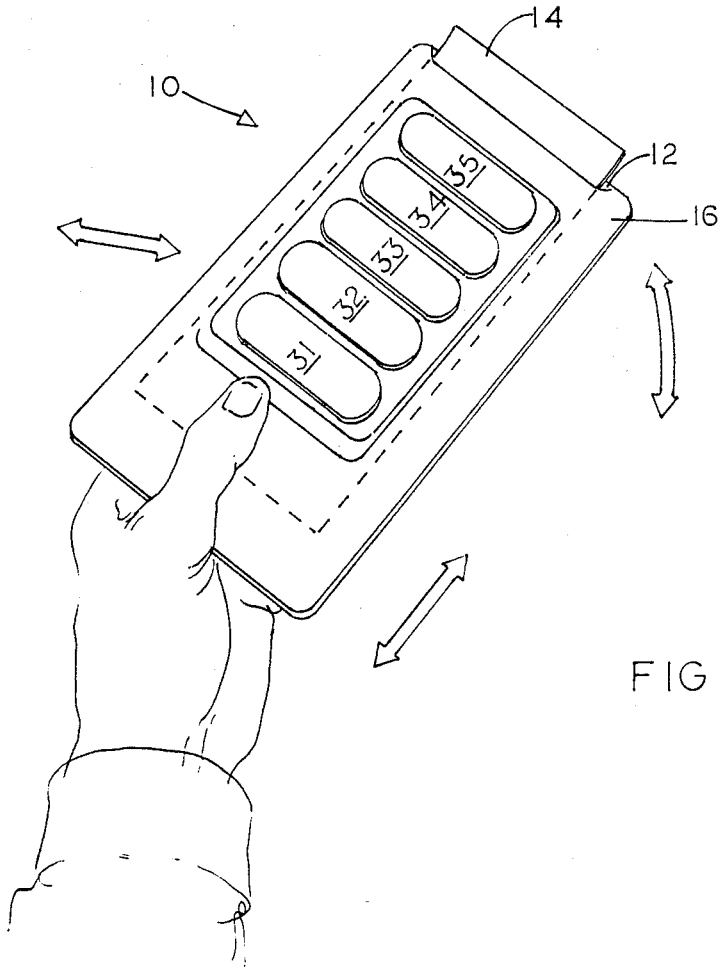
FIG 3
FIG 4
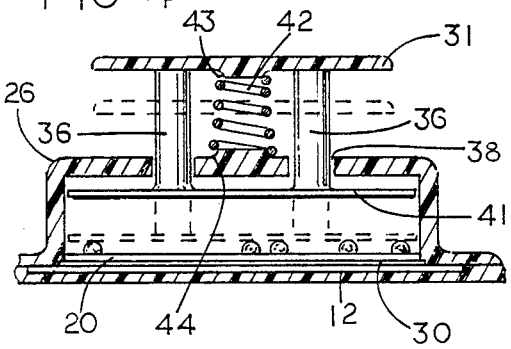
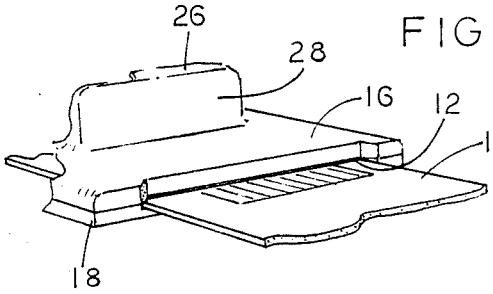
FIG 5

FIG 6
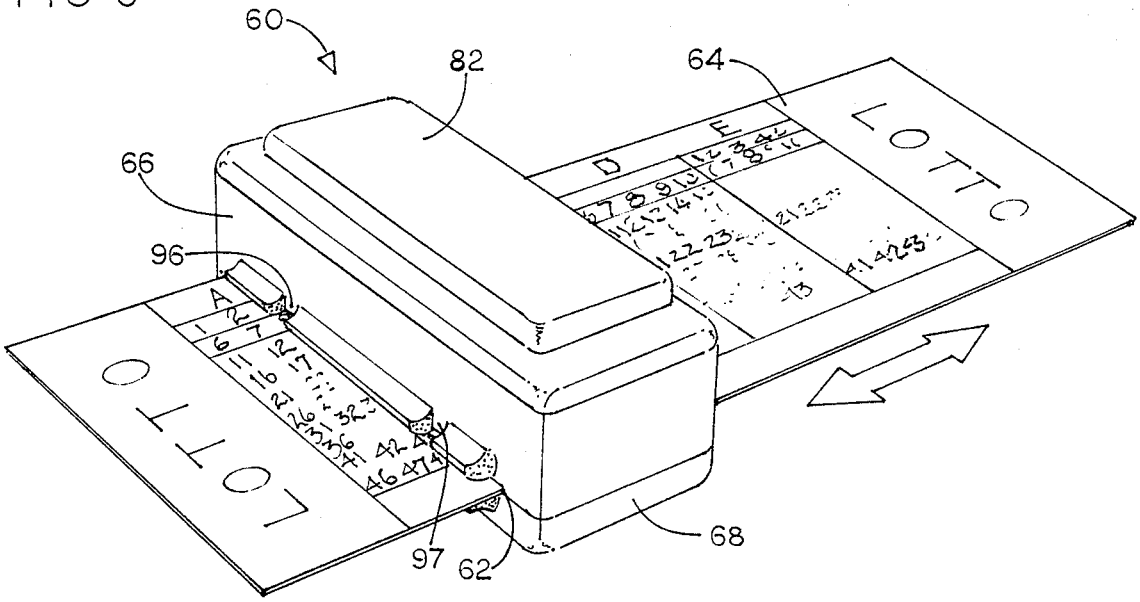
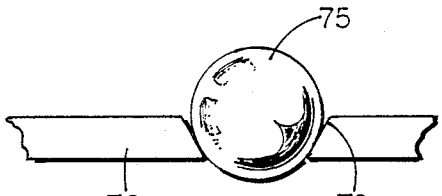
FIG 6a
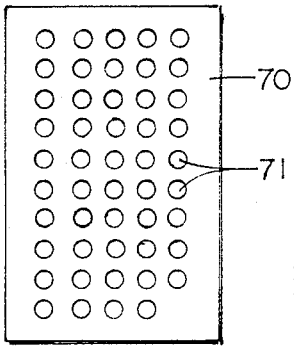
FIG 6b
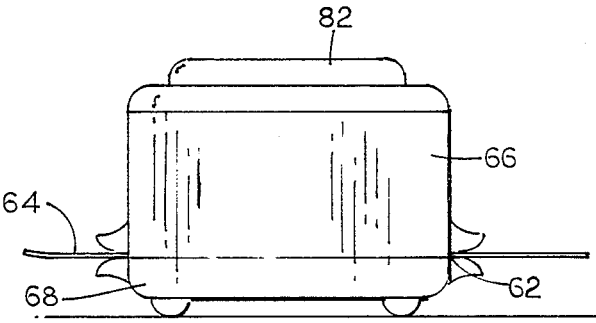
FIG 7a
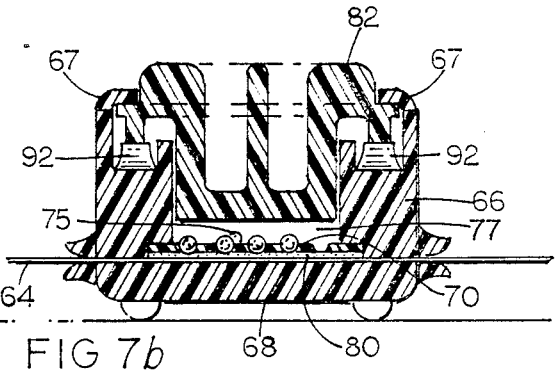
FIG 7b
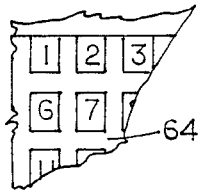
FIG 8a
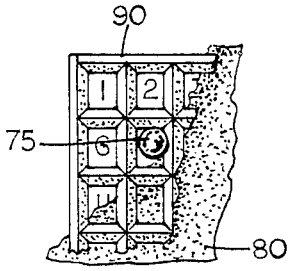
FIG 8b
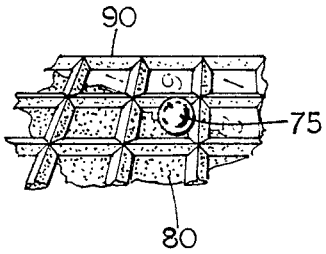
FIG 8c FIG 8d
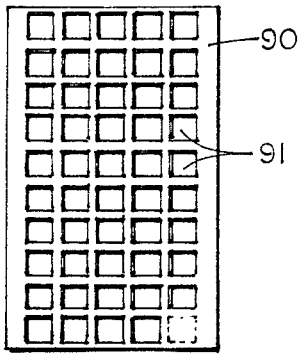
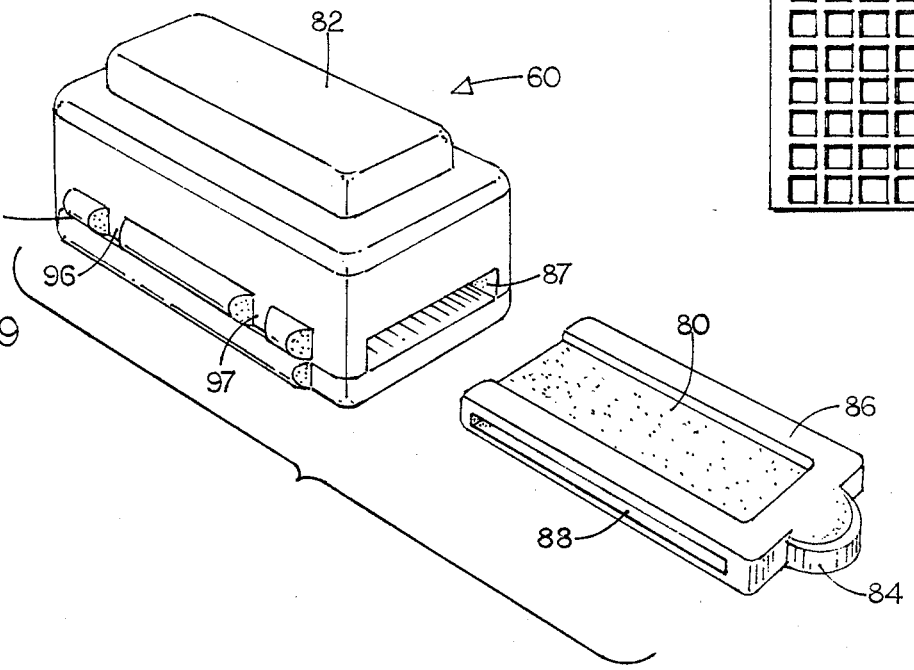
FIG 9
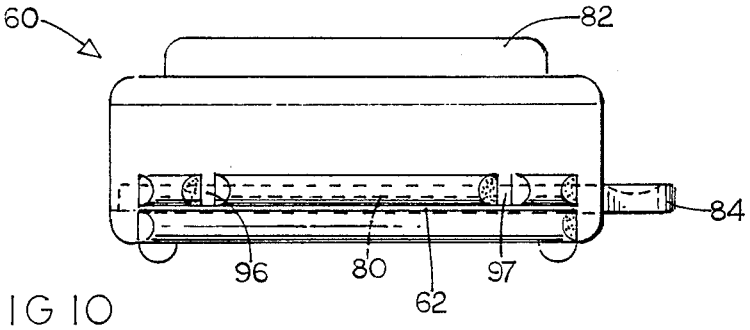
FIG 10
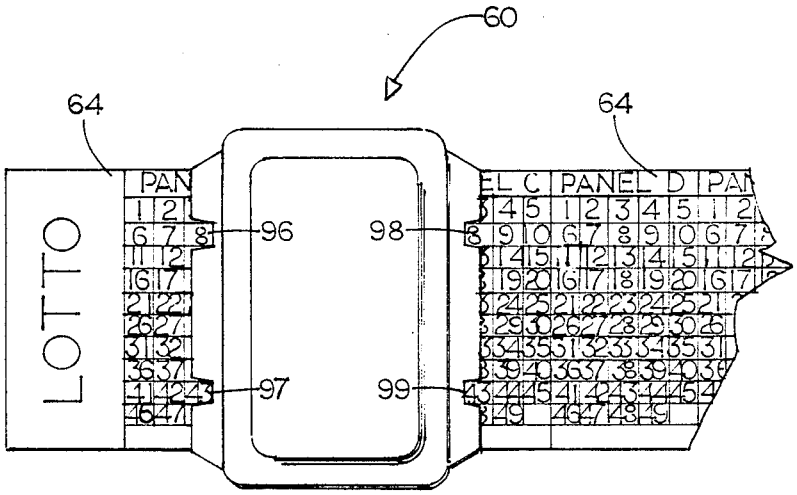
FIG 11

NUMBER SELECTOR AND MARKER FOR LOTTERY CARD

RELATIONSHIP TO THE PREVIOUS INVENTION

This is a Continuation-in-Part of my allowed patent application "Number Selector and Lottery Card Marker," Ser. No. 242,829, filed Sept. 12, 1988, which application is to be abandoned with the filing of this new application.

FIELD OF THE INVENTION

This invention relates generally to devices usable for selecting numbers or groups of numbers, as well as to marking devices generally, and more specifically, this invention relates to a hand held device enabling numbers to be randomly selected and a lottery ticket to be readily marked to reflect the selection. This invention was the subject of Disclosure Document No. 198,665 entitled "Lott O Matic," dated Aug. 18, 1988.

BACKGROUND OF THE INVENTION

A number of states of the United States, as well as countries such as Canada, have decided to solve their financial and budgetary problems by conducting lotteries, involving in most instances tickets, cards or play slips to be marked by the purchaser. Lottery ticket buyers that buy a single lottery ticket, or a number of such tickets, are faced with the problem of selecting the numbers to be played, and then marking the lottery ticket to reflect an accurate version of the selected numbers.

The purchaser paying money into the state is of course hoping that by entering numbers on the purchased ticket that are eventually selected as a winner, he or she will regain substantially more money than he or she paid in. The state, however, is careful to minimize the fact that the odds against a given person winning any substantial amount of money in a lottery are several million to one.

Notwithstanding the fact of the enormous odds against winning, the population flocks to the grocery store, the service station, the all-night liquor store, the drug store, and every other conceivable kind of merchandising operation wherein lottery sales have become a major source of activity. As the frantic lottery ticket purchaser grasps his ticket to instant wealth, he is confronted with a real dilemma—how to select the numbers to be played, and how to mark the ticket or tickets in order to accurately reflect the selected numbers.

The present invention solves these problems and frees the ticket purchaser from the uncertainty of which numbers to play, and provides a simple, low cost, efficient and effective means for marking the ticket immediately after such number selection.

SUMMARY OF THE INVENTION

The present invention comprises a plurality of embodiments of hand held number selector and lottery ticket markers of unique and low cost construction, that greatly assist the player by selecting the numbers to be played, and then accurately marking the lottery card, ticket or play slip in a rapid and accurate manner.

For convenience and consistency of description, the card or play slip actually marked by the player or customer will herein be called the lottery card. As is known, after being marked, the lottery card typically is inserted, usually by the store employee, into a card reader that is an essential part of the computer or number processor into which the selected numbers are inserted. As a result of inserting the lottery card into the card reader, the computer or number processor then delivers a ticket having printed thereon, numbers corresponding to the numbers marked on the lottery card by the player. The player must be careful to safeguard such ticket, for it may represent the winning numbers, and it is incumbent upon the lucky player to produce the ticket containing the winning numbers if he or she expects to be able to claim the prize.

Some people deciding to play the lottery have the numbers to be played already selected, so he or she need only pick up a lottery card or play slip, and proceed to darken boxes of the game grids or panels of the card or play slip by the use of a dark pencil or ball point pen, in order to actually select the numbers he or she is to play.

Other people, however, arrive at the store or market with only the thought in mind of investing a certain amount of money in the lottery, be it $5.00, $10.00, $50.00 or whatever, and only upon arriving at the scene do they endeavor to select which groups of numbers to play. After selecting the numbers, the purchaser then has the problem of accurately marking the card, so that upon being inserted into the card reader of the computer, he or she can reasonably anticipate the delivery of a ticket that has been imprinted with the number he or she has selected by the use of the lottery card.

Accordingly, it is one of the main purposes of this invention to help the purchaser decide which numbers to play, and upon the numbers being selected, to assist the purchaser in the accurate and speedy marking of the lottery card.

As will be seen in more detail hereinafter, a first embodiment of a number selector and card marker in accordance with this invention usable in connection with the marking of a card or play slip comprises a housing having substantially flat, generally rectangular upper and lower housing members. A slot or aperture is formed between at least a portion of the upper and lower housing members, into which slot the lottery card, play slip or the like marked by the player can be inserted. The upper housing member has a perforate plate containing series of closely spaced, carefully aligned holes of an equal size therein. These holes are in a rectangular array, and disposed in columns and rows. Importantly, the placement of the perforate plate with its series of holes must carefully coincide with the locations of the boxes to be found in the game grids or panels of the lottery card to be marked.

A plurality of enclosures, such as transparent enclosures, are disposed on the upper housing member of this first embodiment, which serves to enclose the series of holes, and to contain a plurality of small, equal size spheres, which are captive in each enclosure. Each of these spheres is slightly larger than the holes, so as not to be able to pass therethrough. The size relationship of the spheres to the holes is such that a small portion of each sphere extends below the hole in which it resides when the spheres have come to rest in respective holes of the perforate plate.

A marking member is located between the upper and lower housing members, and directly below the series of holes. A slot is formed between the marking member and the lower housing member for receiving the lottery card to be marked, and means are slidably disposed in the enclosure for applying pressure to the spheres when they have been received in respective holes of the series of holes in the perforate plate. The pressure applied to the spheres manifests itself through the marking member to such an extent as to bring about a marking of the card, such that it may thereafter be read, with such marking of the card being in respective boxes of the game grids of the card. Thus, a set of marks accurately representing the selected sphere array is created on the panels or game grids of the lottery card. A card marked by my device is man readable as well as machine readable.

I am not to be limited to a number selector and lottery card marking device having five or so enclosures, each containing it own series of balls or spheres, for in accordance with another embodiment of my invention, I may utilize a single chamber or enclosure in which spheres are trapped, and I may utilize a perforate plate in which only one set of carefully aligned holes are contained. In the case of the Florida Lotto Card, there is only one set of 49 holes accurately arranged in columns and rows of this secondary embodiment.

When a number selector and marking device in accordance with this invention contains only a single set of 49 or so holes, it is obviously necessary for the player to move the lottery card in a very accurate manner to successive new positions with respect to the perforate plate utilized in the lower part of the device, in order that all the game grids can be marked. To that end, I provide a plurality of alignment devices or marks that the player can utilize at such time as he or she is moving the lottery card in order to bring about the marking of the next panel or game grid of the card.

It is therefore a primary object of my invention to provide a number selector and card marker packaged in one convenient, low cost and easily utilized device.

It is another object of this invention to provide a number selector making it conveniently possible for a lottery player to rapidly select numbers to be played, and thereafter to achieve a prompt and accurate marking of the lottery card to reflect such number selection.

It is still another object of this invention to provide a number selector and card marker in which separate chambers are utilized on a handheld device, in each of which chambers are a number of small balls or spheres which, when the device is shaken, can on a random basis find a hole in which to reside, with the placement of the balls or spheres thereafter being readily and accurately transferred onto the lottery card.

It is yet another object of my invention to provide a low cost, highly effective, easily operated device for solving the problem of a lottery player, of which numbers to select.

These and other objects, features and advantages of my invention will be more apparent from a study of the enclosed drawings and the following description.

BRIEF DESCRIPTION OF THE DRAWINGS

FIG. 2 is a top view of the first embodiment in accordance with this invention, with different portions of the device removed so as to reveal the construction utilized at different levels or layers of this embodiment of my device, including balls or spheres residing in certain of the holes of the perforate plate;

FIG. 3 is a view of my device as it is held in a player's hand at the time the balls or spheres are being shaken;

FIG. 4 is a cross-sectional view of a portion of the first embodiment, prepared to a larger scale, with selected portions cut away to reveal internal construction;

FIG. 5 is a fragmentary perspective view revealing the slot in the housing, into which the lottery card is to be inserted;

FIG. 6 is a perspective view of a less expensive embodiment of my invention, involving a marking device having provision for marking only a single panel or game grid of a lottery card at a time;

FIG. 6*a* is an enlarged cross-sectional view, revealing how the lower part of a typical ball or sphere residing in a hole in the perforate plate protrudes below the layer boundary of the perforate plate, so as to be in a position to mark the rectangle of a lottery card;

FIG. 6*b* is a top view of a typical perforate plate of the type having circular holes, disposed in an array corresponding to a single panel or game grid of a lottery card;

FIG. 7*a* is an end view of the embodiment of my invention depicted in FIG. 6, revealing a lottery card inserted into the card-receiving slot;

FIG. 7*b* is a cross-sectional view closely relatable to FIG. 7*a*, and revealing internal construction;

FIG. 8*a* is a fragmentary view of a typical section of a lottery card, revealing the grid pattern thereon;

FIG. 8*b* is a fragmentary view of a portion of the hole pattern in a perforate plate having rectangularly shaped holes rather than circular holes, with the size relationship of a typical ball or sphere being revealed;

FIG. 8*c* is a perspective view of the rectangular hole array of FIG. 8*b;*

FIG. 8*d* is a plan view of a typical perforate plate utilizing rectangularly shaped holes;

FIG. 9 is a perspective view from a similar angle to that depicted in FIG. 6, with FIG. 9 revealing an embodiment in which the marking member is mounted on a device that is removable for the purpose of replacement;

FIG. 10 is a si de view of the device of FIG. 9, revealing the marking member in place, and showing the slot for the lottery card that is disposed immediately below the marking member;

FIG. 11 is a view taken of the top of a housing member in accordance with a low cost embodiment of my invention, revealing in this instance how a plurality of notches or sighting marks in the edges of the housing member can be used to line up with certain numbers on the lottery card, with the alignment of those certain numbers with the notches or marks assuring that all the numbers on the panels of each card will coincide with the holes in the perforate plate;

DETAILED DESCRIPTION

Figure 1:
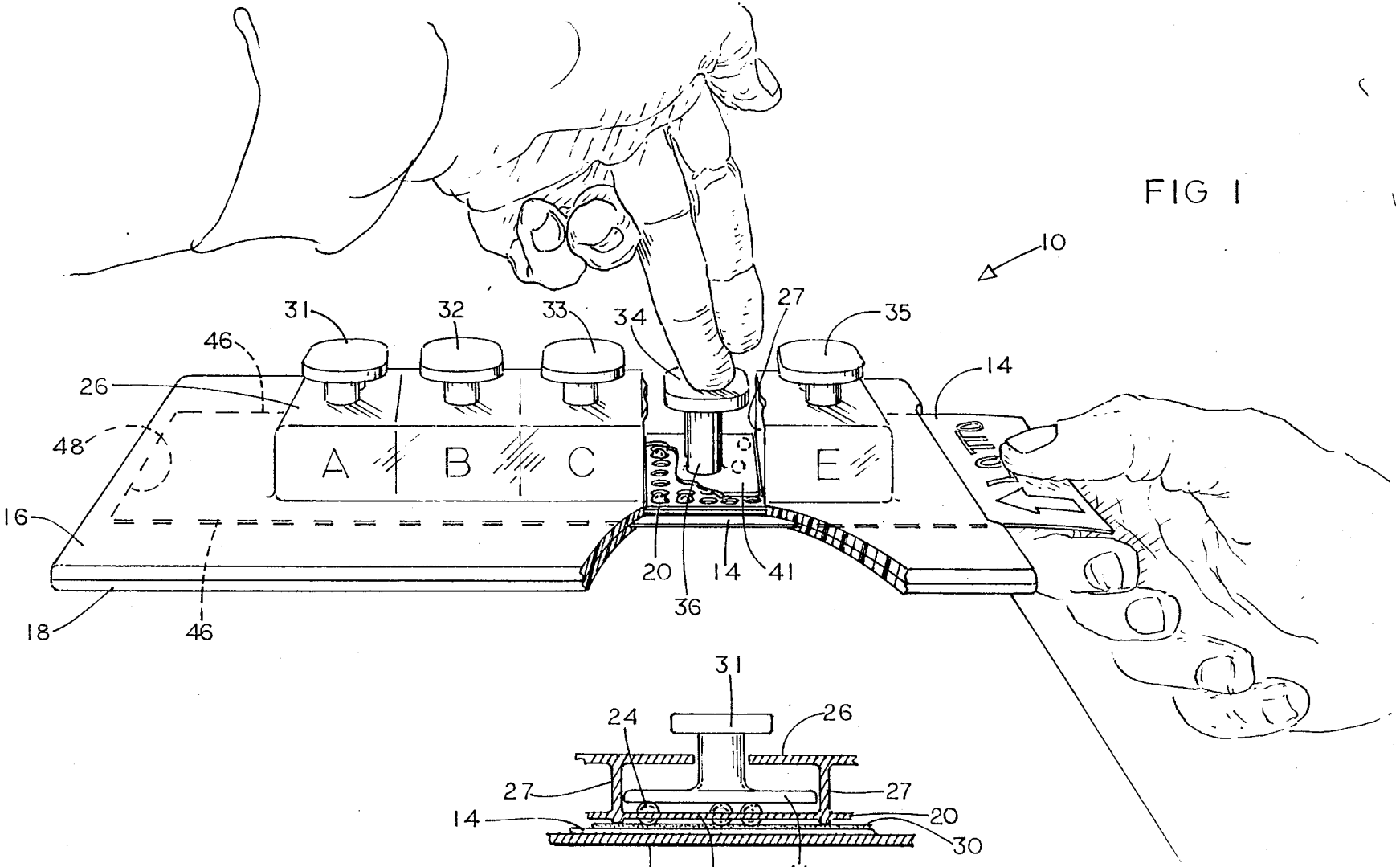
FIG. 1 is a perspective view of a first embodiment of a number selector and card marker device in accordance with this invention, with part of this device being broken away to reveal internal construction.

With initial reference to FIG. 1, it will be seen that I have there shown first embodiment of a number selector and card marker device 10 in accordance with this invention. Into a slot 12 of this device, a considerable portion of a lottery card 14 is being inserted. The lottery card will reside generally in the plane of the number selector and card marker.

The card marker 10 is principally constituted by upper and lower housing members 16 and 18 secured together in the manner best seen in FIG. 4. The flanges of the upper and lower housing members may be secured together by any of a number of suitable means, such as by gluing or sonic welding in case the components are made of plastic, or by rivets, screws, or other fasteners in the event the members are of light metal or another suitable material.

The upper housing member 16 of this embodiment, which is preferably of plastic, has formed therein a perforate plate 20 in which are disposed a series 21 of carefully placed holes 22, as will be seen in the two left panels of FIG. 2. These holes 22 are of uniform size, and are in a highly accurate rectangular array, disposed in what may be regarded as columns and rows in the perforate plate 20. The perforate plate 20 is typically injection molded, utilizing a stable molded compound, such as a polycarbonate, glass filled nylon, or PVC.

Disposed atop the series 21 of holes of this embodiment are a group of five chambers, designated as chambers A through E in FIG. 1. Directly below each of these chambers are 49 holes, laid out in five columns and ten rows in the perforate plate 20. The 50th hole in each chamber may or may not be formed, for the Lotto Play Slip or lottery card utilized in Florida only has 49 boxes in each panel. Thus, for a device to be used in Florida, the 50th hole is not formed in each part of the perforate plate. A number of small balls or spheres 24, preferably in the nature of small steel shot or other hard material, are contained in each chamber, and in Florida, six spheres are used. The balls or spheres I use are quite close to being perfectly spherical, and instead of steel, may be made of a hard plastic, such as nylon, LEXAN or the like. The manner in which the lower surface of a typical ball or sphere protrudes below the perforate plate, so as to be able to mark a card disposed below the perforate plate, is revealed in FIG. 6a.

The Florida Lotto Play Slip has five panels, designated as Panels A through E, with the 49 holes in the perforate plate of each chamber A through E carefully corresponding to the locations of the boxes in the several related panels or game grids located on the Lotto Play Slip.

Quite obviously, my invention is not limited to devices utilizing a perforate plate having a certain number of holes, or to holes that are circular, for the broad principles of my device are applicable to the marking of a large number of different types of cards, tickets, play slips and the like, as may be used in other states, in Canada, in the countries of Europe, or the like. In Canada, for example, the lottery card has six panels or game grids.

Figure 1A:
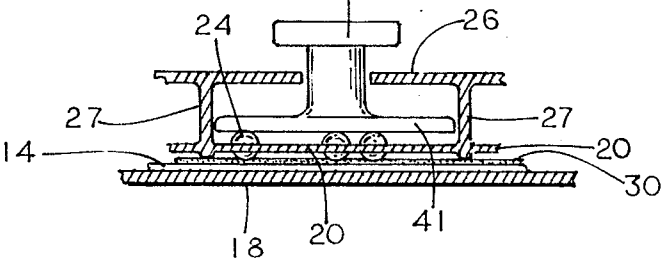
FIG. 1*a* is a sectionalized view to a somewhat larger scale, revealing preferred construction of the means by which a given pushbutton can accomplish a sufficiently dark marking of the inserted lottery card.

I preferably utilize a top plate 26 forming the covering for all five chambers A through E, with it to be understood that a plurality of vertically disposed divider members 27 are utilized therewith, which extend downwardly from the top plate 26 so as to subdivide the chamber array into five separate chambers of substantially equal size. The top plate is preferably transparent, but this is not an absolute requirement. One divider member 27 is visible in FIG. 1, and two divider members are to be seen in FIG. 1a. Because of the divider members, the six or so balls or spheres intended to be used in each chamber are captive in those respective chambers, and cannot move from one chamber to an adjacent one.

The holes 22 are each slightly smaller than the balls or spheres 24, such that the balls cannot pass through the holes. The holes are only slightly smaller than the balls, however, and the top edges of the holes are "broken" or countersunk to a degree sufficient to permit a portion of each ball to actually extend to some degree below the bottom boundary of the upper housing member 16. Note FIG. 1a in this regard, where it is apparent that the lower sphere portions are in effective contact with the marking member 30, discussed hereinafter. As previously mentioned, in FIG. 6a I reveal an enlarged showing in which the sidewalls of the hole are tapered to permit deep penetration of the ball or sphere.

As should be readily apparent, by the user grasping the embodiment of this invention represented by device 10, and shaking same in the manner shown in FIG. 3, each of the six or so balls or spheres in each chamber can each be caused, when the device has been returned to essentially a horizontal attitude, to randomly enter one of the holes 22 of the perforate plate of its respective chamber. Thus it can be seen that one of the goals of my invention has been fulfilled, that is, the ready selection of the numbers to be played with respect to each panel or game grid of the lottery card or play slip.

The other goal, of actually marking the card, is furthered by the use of the pushbutton devices 31, 32, 33, 34 and 35 that, as seen in FIGS. 1 and 3, are respectively associated with chambers A through E. I may also choose to call the pushbutton devices 31 through 35 marking devices or pressure applying members.

With reference now to FIG. 4, it can be seen that the portion of the pushbutton device or marking device 31 actually contacted by the finger or fingers of the player is supported by a pair of short shafts 36 of equal length, which extend down through appropriately placed holes 38 formed in the top plate 26 covering the series of chambers. Inasmuch as the chambers A through E of this first embodiment are substantially if not precisely identical, and each use substantially identical if not precisely identical components, my invention, for convenience, is being described in some instances with regard only to a single chamber.

The bottom ends of the short shafts 36 are secured to a ball-contacting member 41 that is flat and rectangular in shape, and only slightly smaller than the chamber in which it is operatively disposed. A compression spring 42 is utilized between the top plate 26 and the underside of each pushbutton device of the five chambers, which of course are pushbutton devices 31 through 35. These springs serve to keep the respective pushbuttons biased to their uppermost positions, and the top side of the ball contacting member 41 disposed in contact with the underside of the top plate member 26. To prevent dislodgment or misalignment of the spring 42, I may utilize a slight protuberance 43 on the underside of the finger-contacting portion of each pushbutton or pressure applying device 31, and a protuberance 44 in alignment therewith on the upper surface of the top plate member 26, with which the compression spring 42 interacts.

Because each ball-contacting or sphere-contacting member 41 is only slightly smaller than the chamber in which it is vertically movable, it can be expected to contact the tops of all six balls substantially simultaneously when the balls or spheres have each randomly come to rest in respective holes of the perforate plate located within the confines of that chamber. Therefore, after causing the balls to seek holes and repose therein, the player can press down on the pushbutton device 31, 32, or whichever, in order to cause the respective marking device or ball contacting member 41 to press down hard on all six balls or spheres of that chamber at substantially the same instant.

As also visible in FIG. 4, as well as in FIG. 2, I dispose a marking member 30 just below the upper housing member 16, closely adjacent the underside of the series of holes 21 of perforate plate 20. This marking member 30 can be in the nature of a single piece of carbon paper, or it can be of cloth or plastic that has been impregnated with black ink. The marking member 30 is disposed just above the slot 12 into which the player is to insert the Lotto card 14; note FIG. 1*a*. I may utilize a marking member 30 that is a permanent part of the device 10, or the marking member 30 can be of a slide in - slide out nature that reposes just under the series of holes 21 of the perforate plate 20. This latter detail will be discussed shortly.

Presuming the player has correctly inserted the card or Lotto Play Slip into the slot 12 provided in accordance with the first embodiment of this invention, panel A of the card or Lotto Play Slip should coincide with the series of holes of chamber A, panel B of the play slip should coincide with the series of holes of chamber B, and so forth, including panel E coinciding with the location of the series of holes of chamber E.

To assure correct alignment of the lottery card or play slip 14 in a left-right sense, I prefer to use side members 46 on the lower housing members of this first embodiment, which side members are only very slightly further apart than the width of the card, ticket or play slip. These side members 46 are in direct contact with the underside of the edges of the upper housing member. Obviously I could use another arrangement for establishing the distance the upper member 16 is spaced from the lower member 18, but the use of the side members 46 is convenient, and at the same time assures proper card alignment in a left-right sense.

Likewise, I provide a member 48 on the innermost edge of the lower housing member 18 to limit the entry of the lottery card or play slip. This inner member or stop serves to prevent the player inserting the lottery card 14 too far into the first embodiment of my device which, of course, would cause the ball imprint not to coincide with the placement of the boxes in the various panels or game grids of the lottery card or play slip. The placement of member 48 is indicated in FIG. 1.

In Florida the Lotto Play Slip is 3¼ inch wide and 8½ inch long, but obviously my number selector and card marker 10 is not to be limited to receiving play slips or cards of that or any other particular dimension.

It is important to realize that because of the precision manner in which the series of holes 21 are laid out and formed in the perforate plate 20, and the precision way the housing members are created, the balls or spheres can be expected to reside in the holes of the perforate plate in a manner that coincides precisely with the corresponding positions of the various boxes of the game grids depicted in each panel of the lottery card. As will be noted hereinafter, I may in some instances prefer to utilize a perforate plate wherein each hole of the carefully laid out series of holes is of rectangular cross-section. I prefer the use of injection molding techniques, and as previously mentioned, I prefer to use a very stable plastic, such as a suitable polycarbonate, glass filled nylon, or PVC in the creation of the perforate plates.

The mold I used for the creation of perforate plates of injection molded material was created of tool steel, hardened and ground, with the hole locations established to an accuracy of 0.0002 inches, such as by the use of a computer controlled machining center.

As should now be apparent with respect to this first embodiment, upon the player shaking the balls until they have each randomly come to rest in a respective hole, the player can immediately thereafter bring about the marking of the lottery card or play slip so that it will accurately reflect the positions into which the six balls or spheres of each chamber have come to rest in the 49 holes associated with each chamber. To accomplish such marking, the user need only push down on the pushbutton member or pressure applying device of each chamber in order to cause the balls or spheres 24 of that chamber to push down hard upon the marking member 30 disposed immediately above the lottery card or game slip 14. Because of the pre-inking of the marking member 30, the pressure transmitted through each ball or sphere 24 brings about the conspicuous and appropriate marking of the boxes of the card that coincide with each hole of the perforate plate 20 of the upper housing member 16; note FIG. 1*a*. The card becomes man readable as well as machine readable.

The portion of the lower housing member 18 directly below the card to be marked is created to form a firm and stable base, so that the card or play slip can be readily, accurately and conspicuously marked by the player using the marking device to cause the balls or spheres to press down upon respective portions of the lottery card 14 via the marking member 30.

As previously indicated, in accordance with the Florida Lottery, the player, if he or she wishes, need only spend the money involved in selecting one set of numbers of a given Lotto Play Slip, which of course means that the user need only press down upon the first marking device or pushbutton member 31. At the present time, it costs $1.00 to play each set of six numbers in Florida, so if the player wishes, he or she need only select numbers for the first panel, Panel A of the card.

More likely than not, however, the player will want to play several sets of numbers. In that event, the player should press down, typically in sequence, as many of the pushbuttons or marking devices as he or she wishes to, up to five in this first embodiment of my invention.

It is to be realized that my novel device is not limited to any particular configuration, nor to the use of any particular materials. Because I use identical balls or spheres for each chamber, and use pushbuttons or pressure applying devices, springs, and the like that are identical or substantially identical, each embodiment of my device readily lends itself to economical production.

The broad principles of my invention are obviously such as to warrant this invention not being limited to five enclosures or chambers, to six balls, or to any particular constructional techniques, and with regard to this fact, particular reference is now made to the embodiments of my invention depicted in FIGS. 6 through 14. It will be noted in many instances that there is a definite and obvious relationship between the reference number scheme of the first embodiment, and the reference number scheme utilized in connection with FIGS. 6 through 14.

In FIG. 6 it is to be realized that only a single enclosure for balls or spheres is provided in the device 60, and it is to be understood that in accordance with this embodiment, only a single full panel or game grid can be accommodated in the marking location of the device at any one time. From this it should be obvious that the lotto card 64 must be moved to a new or second location after the first group of numbers has been played. After the second group of numbers has been played, the card must again be moved with respect to the upper and lower housing members of the device 60. In other words, it is intended that the lottery card be incrementally moved through the device 60, with a set of six or so numbers being played, at the player's option, at each of the five or so card locations.

I am not to be limited to any particular materials in the construction of my lottery card marking devices, but in the interests of a reasonable pricing structure, I prefer to make the principal portions of a suitable plastic. It is possible, however, when it is desired to make a particularly durable card marking device, to fabricate it out of a light metal, but such is not preferred.

It was of course explained in connection with the embodiment of FIGS. 1 through 5 that the series of holes 21 in the perforate plate 20 of the upper housing member 16 are carefully laid out in precise columns and rows. The positions of the series of holes carefully correspond to the locations of the numbered rectangles of the panels or game grids of the particular lottery card that is utilized in the state or country involved. In a like manner, the series of circular holes 71 in the perforate plate 70 of FIG. *6b*, and the series of rectangular holes 91 in the perforate plate 90 of FIG. *8d* are carefully laid out in order to precisely correspond with the positioning of the game grid rectangles of the lottery cards to be utilized therewith.

Inasmuch, therefore, as precision construction has been used throughout my device, and the card-receiving slot or space 62 between the mid portions of the upper and lower housing members is precisely formed, the marking of the card or play slip by the pressure applied through the balls or spheres 74 can be expected to very closely coincide with the placement of the boxes in the game grids or panels of the lottery card or play slip.

As previously mentioned, FIG. *6a* reveals to a substantial scale how a typical hole 72 in the perforate plate 70 is configured to permit the ball or sphere 75 to fit firmly in the hole, with the lowermost surface of the ball or sphere protruding below the lower boundary of the perforate plate 70. As is obvious, if the perforate plate is too thin, the balls or spheres will not be able to remain stably in the holes in which they initially come to rest, whereas if each hole is not configured to permit the ball settling therein to protrude below the lower boundary of the perforate plate, it would not be possible for the ball to bring about an acceptable marking of the lottery card through the use of the intervening marking member 80.

Accordingly, I either form the holes in the general manner and configuration shown in FIG. *6a*, or else I counterbore the holes somewhat, subsequent to their being formed, so that I can be assured that each ball or sphere will sit properly in each hole of the perforate plate.

With reference to FIG. *7a*, it will there be seen that the lottery card 64 extends through the slot 62 provided in a mid portion of the housing member of the device 60. The slot 62 extends from side to side through the device 60, and may reside at the location corresponding to the juncture between the upper housing member 66 and the lower housing member 68, as revealed in FIG. *7b*, but obviously I am not to be limited to this single location.

It is important to note in FIG. *7b* that a given panel of the lottery card 64 resides directly below the marking member 80, with the marking member in turn reposing directly below the perforate plate 70. It should by now be abundantly clear that the balls or spheres must be pressed firmly downwardly by the marking device or pushbutton 82 into contact with the marking member 80 and the card 64, in order for readily discernable marks to be made on the lottery card. Therefore, I prefer for the inner portion of the lower housing member 68 to present a flat, sturdy surface to the particular card portion it supports at a given moment.

In view of the fact that I prefer to manufacture the upper and lower housing members 66 and 68 of a suitable plastic, I typically prefer to secure the adjacent margins of the upper and lower housing members together by sonic welding, although other means such as glue, elongate screws, or the like could be utilized if preferred. The securing together of the upper and lower housing members is of course accomplished while permitting the slot 62 to extend without interruption entirely through the device 60.

In FIG. *7b* I show a cross-sectional view of the device 60, in which is visible the perforate plate 70, and the six or so balls or spheres 74 trapped in the enclosure 77, which balls or spheres on occasion are caused to reside in randomly selected holes in the perforate plate. In this figure I deliberately show a single sphere 75 that has not been properly seated, and it is to be understood that the player should not endeavor to cause the lotto card 64 to be marked until all of the balls or spheres contained in the enclosure have been seated in the round, square or rectangular holes of the perforate plate.

The marking of the lottery card 64 is accomplished by the pushbutton or marking device 82 that is slidable in a vertical manner in the upper housing member 66. A pair of compression springs 92 are provided on each side of the pushbutton member 82, so that it will normally be biased into its upper position, which is depicted in FIG. *7b*. It is to be realized that I may utilize either a pair of leaf springs, or a pair of coil springs at recessed locations in the upper housing member on each side of the pushbutton 82. I typically prefer to use leaf springs instead of coil springs in my devices, inasmuch as leaf springs make it possible for such devices to have less height, or in other words, leaf springs make a more compact design possible. Depending on the particular design, the leaf springs might be generally L-shaped or generally U-shaped.

As is obvious, the lower surface of the pushbutton or pressure applying member 82 should be flat and of hard material, so as to assure all of the spheres being pushed with even force down against the marking member and the lottery card when the user pushes down upon the upper part of the pushbutton 82.

It will be noted that the upper housing member 66 is configured to have a shoulder 67 on each side of the pushbutton 82, to keep the springs 92 from forcing the pushbutton or marking device out of the upper housing member 66 when the user is not pushing down on same.

As should now be clear, the arrangement is such that after all of the balls or spheres 74 trapped in the chamber or enclosure 77 have randomly been caused to become properly seated in certain of the holes of the perforate plate 70, the pushbutton member 82 may be firmly depressed by the player, in order to bring about a sufficiently dark marking of the card 64, accomplished by the plurality of balls or spheres 74. Again, the card 64 is of course disposed in the slot 62, immediately below the marking member 80.

Visible in FIG. 8*a* is a fragmentary section of a typical lottery card 64, revealing to a somewhat larger scale, the numbers that have been printed in each of the rectangles on the game grid or panel of the card. It should now be clear that all of the holes created in the perforate members in accordance with my invention must be spaced to carefully coincide with this placement of the rectangles on the game grid or panel of each lottery card.

With reference now to FIG. 8*b*, it will be noted that I have here depicted to a similar scale to that used i n FIG. 8*a*, a fragmentary portion of a perforate member 90 in which generally rectangularly shaped holes, rather than circular holes, have been formed. Inasmuch as the marking member 80 is located below the perforate plate 90 but above the lottery card 64, it will be noted in FIG. 8*b* that the marking member 80 has been partially removed to make the numbered rectangles on the lottery card visible. The sphere 75 depicted in FIGS. 8*b* and 8*c* is of a size to protrude below the lower boundary of the perforate member, but not to pass through any of the rectangularly shaped holes.

In FIG. 8*c* I provide a perspective view of several of the generally rectangularly shaped holes, and from this figure it can be seen that these holes do not have vertical sidewalls. Rather, the sidewalls of each rectangular hole are sloped or angled somewhat, so that the lowermost surface of each ball or sphere can readily protrude through the lower boundary of the perforate plate. It is to be understood that the ball or sphere 75 is of a size not to fall through the rectangularly shaped hole, but nevertheless being of a size to extend below the perforate plate 90 for sufficient distance as to be able to achieve a proper and sufficient marking of the lottery card.

In FIG. 8*d* I reveal an entire perforate plate 90 of the type having generally rectangular (or square) holes instead of the circular holes illustrated in the perforate plate 70 depicted in FIG. 6*b*.

With regard to FIG. 9, the marking member 80 of the device 60 may be seen to be mounted upon a slidably movable frame 86 that is readily inserted into a suitable aperture 87 that may for example be formed at or near the lower portion of the upper housing member 66. The aperture 87 will be noted to be on a different side of the housing member than the slot 62 into which the lottery card is received, and is above latter slot. This is because the balls or spheres being pushed down upon the marking member 80 cause a selected darkening of certain portions of the lottery card—portions that are within the numerous rectangles contained in each panel of the lottery card.

In a manner of speaking, the aperture 87 in the housing for receiving the slidable frame 86 for the marking member may be regarded as 90° away from the slot 62 in which the lottery card is to be inserted. As previously mentioned, the presence of the flat upper surface of the lower housing member 68 immediately below the card 64 contributes significantly insofar as making it readily possible for the user to readily bring about a sufficiently dark marking of the card.

By now it should be manifestly obvious that in order for a select number of the panels or game grids of the lottery card 64 to be properly marked, there must be proper registration between the single set of 49 or so holes in the perforate plate 70 (or 90) of the device 60, and the different boxes or rectangles printed in the several game grids or panels on the front side of the Lottery card.

With further reference to the showing of FIG. 9, the device 60 is understood to be of quality construction, and to be of a size such that only one full panel or game grid can fit at a time within the device 60. The support member or frame 86 is generally U-shaped, with the marking member 80 attached thereto by glue, pressure sensitive adhesive, or the like. In accordance with this embodiment, additional marking members 80 could be purchased from an office supply company, in order that the device 60 can be kept in fully operational condition at all times. When the arms of the frame 86 are of considerable thickness, a wide slot 88 may be utilized in each arm. Thus, when the frame 86 is in the installed position in the housing member, and a lottery card is inserted in slot 62, the slots 88 receive the lottery card at a location very close below the marking member 80.

In FIG. 10 I reveal a side elevational view of the device depicted in FIG. 9, with the marking member 80 shown in the operational position. A handle member 84 is utilized on the end of the support member 86, to facilitate its removal from the upper housing member 66.

Quite obviously I am not to be limited to devices 60 that are made of plastic of high quality, for less expensive devices may be made in accordance with my invention, which are to be thrown away after the reproductive qualities of the marking member 80 have been exhausted, or after the device has become unsatisfactory in any other regard.

The desired registration in accordance with the particular embodiment of my invention depicted in FIGS. 6 and 9 through 11 is accomplished by means of a convenient visual alignment the user must make between the numbered rectangles appearing on the lottery card 64, and suitable sighting marks or alignment marks 96 through 99 that are established at several appropriate locations just above the card slot 62 of the housing member 66. These marks are best seen in FIG. 11. As will be explained shortly, the distance between the marks 96 and 97 has been carefully established, with this distance being the same as the distance between the marks 98 and 99.

Somewhat similarly, the distance between marks or slots 96 and 98 is a carefully established distance, and this coincides with the distance between marks or slots 97 and 99.

It should be clearly obvious that I may also choose to refer to the sighting marks or alignment marks as being sighting slots or sighting notches. The sighting marks or alignment marks (or slots or notches) 96 through 99 will be clearly seen in FIG. 11 to line up precisely with certain numbers appearing on the lottery card 64 that has been carefully inserted into the slot 62 of the device 60.

More particularly, it will be seen in FIG. 11 that by virtue of a particular placement of the card 64 in the device 60, the sighting mark 96 aligns with the number 8 in the first panel of the lottery card 64, which may be nomenclatured Panel A, whereas the sighting mark 97 aligns with the number 43 in this same panel of the card. At the same time, sighting mark 98 aligns with the number 8 in the third panel of the lottery card, which may be nomenclatured Panel C, whereas the sighting mark 99 at the same time aligns with the number 43 appearing in this third panel of the card. It is to be understood that at this time, Panel B of the card 64 is carefully centered in the device 60.

Thus it can be seen that I have designed the device 60 to be of a particular width, and to be precisely configured such that when the sighting marks 96 through 99 have been aligned with the numbers on the card mentioned above, the player can be assured that the holes or apertures in the perforate plate of the device 60 will be in careful alignment with the rectangles of the panel of the card that is located between the panels of the card that are at least partially visible in FIG. 11. In other words, in the illustrated instance, the user can be assured that the numbered rectangles of Panel B of the card 64 are in positions carefully coinciding with the apertures of the perforate plate of the device 60, which is of course not visible in FIG. 11.

Thus, after the player has made this careful alignment of the card in the housing 66, he or she can then proceed to depress the pushbutton 82 on the top of the device 60 with sufficient downward force as to bring about a discernable marking of the rectangles of Panel B of the lottery card, with the marking of course reflecting the randomly selected positions of the balls or spheres 74 as they reside in the apertures or holes of the perforate plate 70 or 90.

It should be obvious to all that this position of the card 64 was chosen so as to enable a clear explanation of the use of all four of the sighting marks or alignment marks 96 through 99 with regard to the numbered rectangles of the inserted lottery card. This is to say, the typical user would first bring about the marking of Panel A, before proceeding with the marking of Panel B and the succeeding panels of the card, but I chose to first explain the marking of Panel B so that the positioning of all of the alignment marks or sighting marks 96 and 97 could be fully explained.

It should also be obvious to all that during the marking of Panel A, only sighting marks or alignment marks 98 and 99 are utilized, with marks 96 and 97 coinciding only with an unnumbered end portion of the lottery card. Similarly, during the marking of Panel E, at the opposite end of the lottery card, only sighting marks or alignment marks 96 and 97 are utilized, with marks or slots (or notches) 98 and 99 coinciding only with an unnumbered portion located at the other end of the lottery card.

After the first panel of the lottery card has been marked, it is then obviously necessary for the player to move the card 64 to a new position in the device 60 if he or she wishes to play another set of numbers. As should be readily apparent, this movement must be for a very precise distance if the balls or spheres 74 located in the enclosure 77 are to be properly utilized to accomplish a discernable and readable marking of the card.

Thus the player proceeds to mark the second panel of the card, and after such has been accomplished, it is again necessary for the player to move the card 64 so that the proper number of rectangles located in the third panel of the lottery card can be marked. It should now be clear that by carefully utilizing the sighting marks or alignment notches, the user or player can readily and reliably align each successive panel of the lottery card by visual means.

Figure 12:
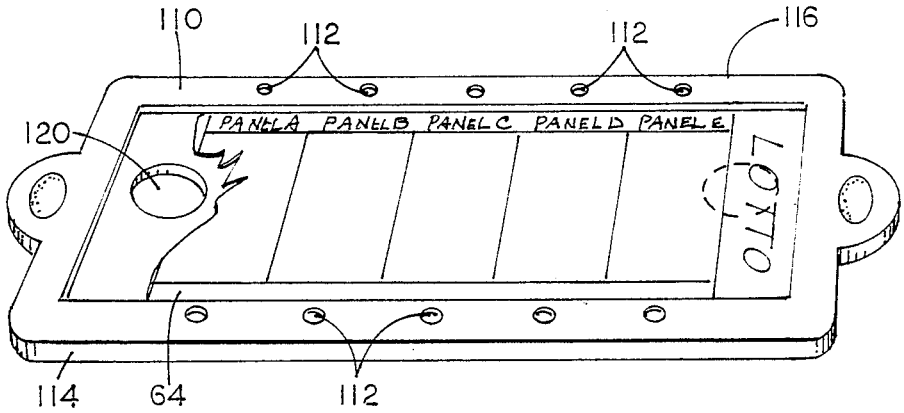
FIG. 12 is a perspective view of a typical card carrier utilized in accordance with another embodiment of this invention, with the card carrier having a pluralitly of shallow, carefully placed holes located along its long edges to assure the proper positioning of the card carrier with respect to the holes in the perforate plate.
Figure 13:
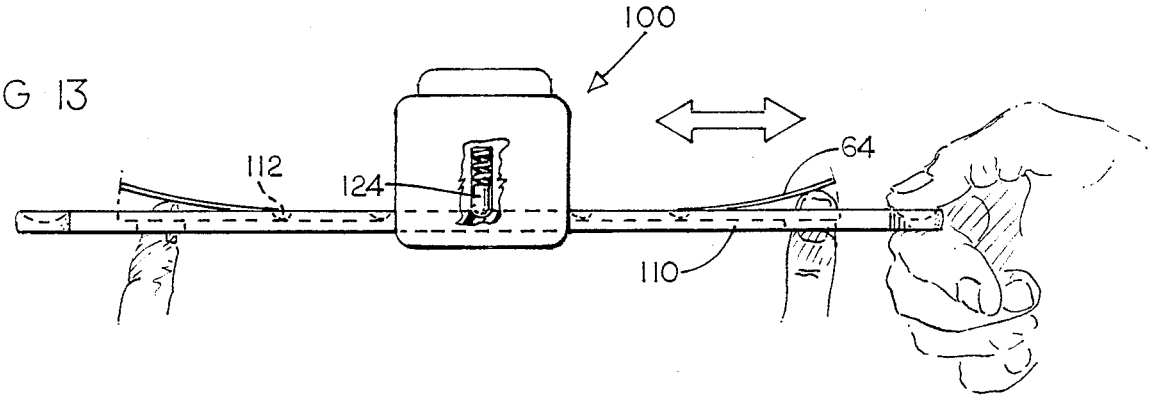
FIG. 13 is an edge view of the card carrier residing in the housing, with part of the housing being broken away to reveal the use therein of a spring mounted pin or plunger member that will enter one of the holes in the card carrier each time one of the panels has been properly aligned with the perforate plate in the housing.

With reference now to FIG. 12, it will there be seen that I have provided an embodiment in which no visual sighting means are utilized in assuring a proper placement of the lottery card in a succession of proper positions in the device 100, such device being depicted in FIG. 13. Continuing with FIG. 12, it will there be seen that I have provided a slidable card support means or carrier 110 to receive the lottery card. As is obvious, the card support or carrier 110 is created to be of a size and configuration so as to snugly receive the card of the particular state or jurisdiction, in a slight recess in the central portion of the carrier. In other words, there is a raised portion around the four sides of the card carrier 110, with these raised portions being positioned so that a lottery card is tightly carried therein, without the possibility of the card sliding to an improper or ambiguous location in the carrier.

Also visible in FIG. 12 are a series of comparatively shallow holes 112 disposed along one or both of the long edges 114 and 116 of the card carrier, these holes being provided for a purpose about to be described.

As shown in FIG. 12, I provide a hole 120 adjacent each end of the card carrier, for a purpose made clear from an inspection of FIG. 13. As is visible in latter figure, the user can readily lift either end of the card away from contact with the card carrier 110 merely by pushing a finger upwardly through the hole. This makes it very easy for the user to re-acquire the card after it has been suitably marked.

It is important to note in FIG. 13 that I have provided a spring mounted pin or plunger 124 in the housing member of the device 110, with the plunger having a rounded lower surface or point, that can readily be caused to successively enter each of the holes 112 evenly spaced along the length of the card carrier 110.

In other words, the pin or plunger 124 in combination with a particular hole in the card carrier amounts to a detent arrangement serving to assure an accurate positioning of a corresponding panel or game grid of the card with respect to the holes of the perforate plate utilized in the housing of this embodiment of my invention. This is to say, each of the holes 112 is carefully positioned with respect to the game grids or panels of the card to be received in the support means or carrier 110, such that upon the player moving the carrier or support means from one detent location to the next, he or she by feel can be assured that the numbered rectangles of the new panel or game grid of the card will carefully correspond with the placement of the holes in the perforate plate of the device 100.

In the arrangement depicted in FIG. 12, either end of the card carrier can be inserted into the slot in the member 100 designed to receive same, with the placement of the holes 112 along both long edges of the card carrier assuring that the card carrier will tend to stop at each proper location of the card as will assure a proper marking thereof. On the other hand, if the card carrier is to be configured to be able to enter the device 100 from only a single direction, the series of spaced holes 112 along one of the long edges can be eliminated.

It is to be realized that because the holes 112 are typically of shallow depth, that no great force is required to move the card carrier from one card marking position to the next. On the other hand, the pin or plunger 124 functions with the series of holes to provide a distinct, unmistakable positioning of the card carrier in proper locations with respect to the housing, such that by feel the user or player can achieve accurate marking of the game grids or panels of the card.

Figure 14:
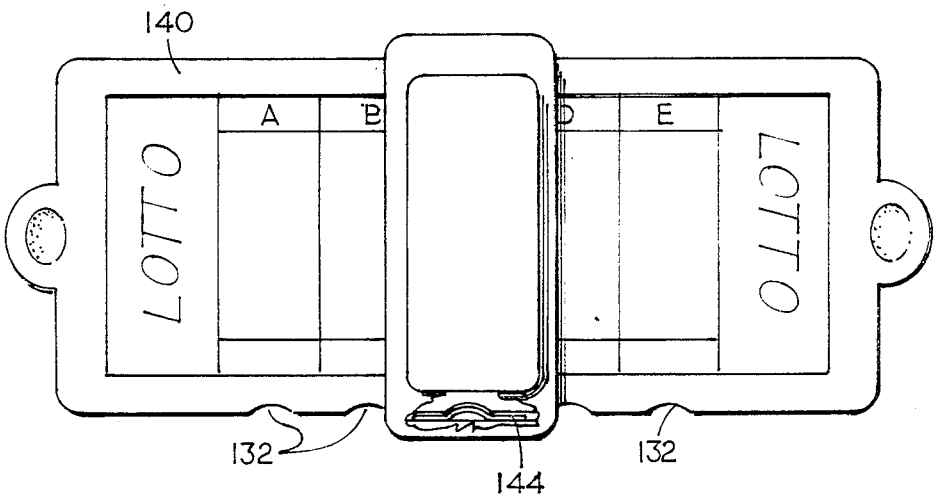
FIG. 14 is a top view of another type of card carrier, this one utilizing rounded notches disposed at spaced locations along a side edge of the card carrier, into which notches a spring biased plunger or detent member can enter in order to assure alignment of the panels of the card with the holes in the perforate plate of the housing.

I am not to be limited to the arrangement revealed in FIG. 12, wherein a spaced series of holes are located along each long side of the card carrier. I say this because as shown in FIG. 14, I may create a different sort of detent arrangement, such as one involving a series of rounded notches 132 utilized along the outer edge or edges of the card carrier. In such instance I utilize a spring biased member 144 in the housing, which is designed to successively enter each notch of the card carrier when the various panels of the card are in proper alignment with the perforate plate of the housing.

It is therefore to be seen that with either the device shown in FIG. 12, or the device shown in FIG. 14, the user can be assured by feel that each of the panels of a lottery card placed in the card carrier will be properly aligned with the holes in the perforate plate, whereby the user can readily bring about an accurate marking of the selected rectangles appearing on the upper surface of the lottery card.

It should now be apparent that I have provided a highly novel number selector and card marker device in which the housing of the device can either be of a size such that substantially the entire card can be received at one time in the slot, or, alternatively, the housing can be comparatively small, such that only one complete panel or game grid of the card can be received at one time in the slot.

In both instances, alignment means are utilized for enabling the user to move the card to successive positions of alignment in the slot in the comparatively small housing, such successive positions of alignment involving the rectangles of each game grid of the card being brought in turn into coincidence with the series of spaced holes.

In the comparatively inexpensive model, the alignment means takes the form of sighting means utilized on the comparatively small housing, so that the user can visually align the card. As an alternative to this, the alignment means can involve the use of a card carrier slidably mounted in the slot in the housing. The card carrier is adapted to receive the card to be marked in an unambiguous location thereon, and the user by feel can quite effectively move the card carrier to a series of distinct positions of alignment with respect to the small housing.

It should now be clear that this invention is of sufficient breadth that it can take a number of different forms or configurations, and I am not to be limited except as required by the scope of the appended claims.

I Claim:

1. A number selector and card marker usable in connection with the marking of a card or play slip, comprising a substantially flat housing having a slot therein for receiving at least a portion of the card, one part of said housing having a series of closely spaced, carefully aligned holes of equal size, disposed in columns and rows, with the placement of the holes of the series carefully coinciding with the placement of boxes to be found in the game grids of the card to be marked, an enclosure serving to enclose said series of holes as well as a plurality of small, equal size spheres, with each of said spheres being slightly larger than the holes, so as not to be able to pass therethrough, the size relationship of the spheres to the holes being such that a small portion of each sphere extends below its respective hole when the spheres have settled into the holes, a marking member located in the housing directly below said series of holes, and closely adjacent the aforementioned slot, and a marking device slidably disposed in said enclosure, for applying pressure to the spheres when they have randomly come to rest in respective holes, the pressure applied to such spheres by said device manifesting itself through said marking member so as to bring about a marking of a card reposing in said slot, to make such card readily readable.

2. The number selector and card marker as recited in claim 1, in which each hole of the series of holes is circular.

3. The number selector and card marker as recited in claim 1, in which each hole of the series of holes is rectangular.

4. The number selector and card marker as recited in claim 1, in which said enclosure is transparent.

5. The number selector and card marker as recited in claim 1, in which said enclosure disposed on said member is in the form of several separate sections of equal size, with an equal number of holes located in each of said sections, and a separate group of the small spheres being captive in each section of said enclosure.

6. The number selector and card marker usable in connection with the marking of a card, ticket or play slip as recited in claim 5, in which a separate means is slidably disposed in each of said separate sections, so that pressure can be applied to the spheres contained in one section when they have been received in respective holes of that section, independent of the application of pressure to the spheres in the other sections.

7. The number selector and card marker as recited in claim 1, in which said marking member is an intrinsic part of said number selector and card marker.

8. The number selector and card marker as recited in claim 1, in which said marking member is readily removable, so it can be readily replaced when a new marker is needed.

9. The number selector and card marker as recited in claim 1 , in which said housing is of a size such that substantially the entire card can be received at one time in said slot.

10. The number selector and card marker as recited in claim 1, in which said housing is comparatively small, such that only one complete panel or game grid of the card can be received at one time in said slot.

11. The number selector and card marker as recited in claim 10, in which alignment means are utilized for enabling the user to move the card to successive positions of alignment in said slot in said comparatively small housing, such successive positions of alignment involving the rectangles of each game grid of the card being brought in turn into coincidence with said series of spaced holes.

12. The number selector and card marker as recited in claim 11, in which said alignment means takes the form of sighting means utilized on said comparatively small housing, so that the user can visually align the card.

13. The number selector and card marker as recited in claim 11, in which said alignment means involves the use of a card carrier slidably mounted in said slot, said card carrier being adapted to receive the card to be marked in an unambiguous location thereon, said card carrier being movable by the user to a series of distinct positions of alignment with respect to said housing, which distinct positions of alignment are achieved by feel.

14. A number selector and card marker usable in connection with the marking of a card, ticket or play slip comprising a substantially flat, generally rectangular housing having a slot or aperture therein for receiving at least a portion of a card or the like in the plane of the housing, one part of said housing having a series of closely spaced, carefully aligned holes of equal size therein, said holes being in a rectangular array and disposed in columns and rows, the placement of the holes of said series of holes carefully coinciding with the placement of boxes to be found in the game grids of the card to be marked, an enclosure disposed on the same side of said housing as said holes, and serving to enclose said series of holes, a plurality of small, equal size spheres captive in said enclosure, each of which spheres is slightly larger than said holes, so as not to be able to pass therethrough, the size relationship of said spheres to said holes being such that a small portion of each sphere extends below the hole in which it resides when the spheres have come to rest in respective holes, a marking member located in said housing directly below said series of holes, said slot being formed closely adjacent said marking member and below the part of said housing having the holes, for receiving the card to be marked, and means slidably disposed in said enclosure for applying pressure to said spheres when they have been received in respective holes of said series of holes, the pressure applied to said spheres manifesting itself through said marking member to such an extent as to bring about a marking of a card reposing in said slot such that the card may thereafter be read, with such marking of the card being in respective boxes of the game grids of the card, in locations corresponding to the array of spheres.

15. The number selector and card marker as recited in claim 14, in which each hole of the series of holes is circular.

16. The number selector and card marker as recited in claim 14, in which each hole of the series of holes is rectangular.

17. The number selector and card marker as recited in claim 14, in which said enclosure is transparent.

18. The number selector and card marker as recited in claim 14, in which said enclosure disposed on said member is in the form of several separate sections of equal size, with an equal number of holes located in each of said sections, and a separate group of the small spheres being captive in each section of said enclosure.

19. The number selector and card marker usable in connection with the marking of a card, ticket or play slip as recited in claim 18, in which a separate means is slidably disposed in each of said separate sections, so that pressure can be applied to the spheres contained in one section when they have been received in respective holes of that section, independent of the application of pressure to the spheres in the other sections.

20. The number selector and card marker as recited in claim 14, in which said marking member is an intrinsic part of said number selector and card marker.

21. The number selector and card marker as recited in claim 14, in which said marking member is readily removable, so it can be readily replaced when a new marker is needed.

22. The number selector and card marker as recited in claim 14, in which said housing is of a size such that substantially the entire card can be received at one time in said slot.

23. The number selector and card marker as recited in claim 14, in which said housing i s comparatively small, such that only one complete panel or game grid of the card can be received at one time in said slot.

24. The number selector and card marker as recited in claim 23, in which alignment means are utilized for enabling the user to move the card to successive positions of alignment in said slot in said comparatively small housing, such successive positions of alignment involving the rectangles of each game grid of the card being brought in turn into coincidence with said series of spaced holes.

25. The number selector and card marker as recited in claim 24, in which said alignment means takes the form of sighting means utilized on said comparatively small housing, so that the user can visually align the card.

26. The number selector and card marker as recited in claim 24, in which said alignment means involves the use of a card carrier slidably mounted in said slot, said card carrier being adapted to receive the card to be marked in an unambiguous location thereon, said card carrier being movable by the user to a series of distinct positions of alignment with respect to said comparatively small housing, which distinct positions of alignment are achieved by feel.

27. A number selector and card marker usable in connection with the marking of a card, ticket or play slip comprising a housing having flat, generally rectangular upper and lower housing members, with a slot or aperture being formed between at least a portion of said upper and lower housing members, into which at least a portion of card or the like can be inserted, a member containing a series of closely spaced, carefully aligned holes of equal size being disposed in one of said housing members, said holes being in a rectangular array, and disposed in columns and rows, the placement of the holes of said series of holes carefully coinciding with the placement of boxes to be found in the game grids of the card to be marked, an enclosure operatively associated with said upper housing member, and serving to enclose said series of holes, a plurality of small, equal size spheres captive in said enclosure, each of which spheres is slightly larger than said holes, so as not to be able to pass therethrough, the size relationship of said spheres to said holes being such that a small portion of each sphere extends below the hole in which it resides when the spheres have randomly come to rest in respective holes, a marking member disposed in one of said housing members, in a location directly below said series of holes, the aforementioned slot being formed between said marking member and said lower housing member, to receive the card to be marked, and means slidably disposed in said enclosure for applying pressure to said spheres when they have been received in respective holes of said series of holes, the pressure applied to said spheres manifesting itself through said marking member to such an extent as to bring about a marking of a card reposing in said slot such that the card may thereafter be read, with the marking of the card being in respective boxes of the game grids of the card, in locations corresponding to the array of spheres.

28. The number selector and card marker as recited in claim 27, in which each hole of the series of holes is circular.

29. The number selector and card marker as recited in claim 27, in which each hole of the series of holes is rectangular.

30. The number selector and card marker as recited in claim 27, in which said enclosure is transparent.

31. The number selector and card marker as recited in claim 27, in which said enclosure disposed on said member is in the form of several separate sections of equal size, with an equal number of holes located in each of said sections, and a separate group of the small spheres being captive in each section of said enclosure.

32. The number selector and card marker usable in connection with the marking of a card, ticket or play slip as recited in claim 31, in which a separate means is slidably disposed in each of said separate sections, so that pressure can be applied to the spheres contained in one section when they have been received in respective holes of that section, independent of the application of pressure to the spheres in the other sections.

33. The number selector and card marker as recited in claim 27, in which said marking member is an intrinsic part of said number selector and card marker.

34. The number selector and card marker as recited in claim 27, in which said marking member is readily removable, so it can be readily replaced when a new marker is needed.

35. The number selector and card marker as recited in claim 27, in which said housing is of a size such that substantially the entire card can be received at one time in said slot.

36. The number selector and card marker as recited in claim 27, in which said housing is comparatively small, such that only one complete panel or game grid of the card can be received at one time in said slot.

37. The number selector and card marker as recited in claim 36, in which alignment means are utilized for enabling the user to move the card to successive positions of alignment in said slot in said comparatively small housing, such successive positions of alignment involving the rectangles of each game grid of the card being brought in turn into coincidence with said series of spaced holes.

38. The number selector and card marker as recited in claim 37, in which said alignment means takes the form of sighting means utilized on said comparatively small housing, so that the user can visually align the card.

39. The number selector and card marker as recited in claim 37, in which said alignment means involves the use of a card carrier slidably mounted in said slot, said card carrier being adapted to receive the card to be marked in an unambiguous location thereon, said card carrier being movable by the user to a series of distinct positions of alignment with respect to said comparatively small housing, which distinct positions of alignment are achieved by feel.

* * * * *